US009024215B2

(12) United States Patent
Chiba

(10) Patent No.: US 9,024,215 B2
(45) Date of Patent: May 5, 2015

(54) SWITCH DEVICE

(75) Inventor: Shingo Chiba, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 75 days.

(21) Appl. No.: 13/997,689

(22) PCT Filed: Dec. 27, 2011

(86) PCT No.: PCT/JP2011/080588
§ 371 (c)(1),
(2), (4) Date: Jun. 25, 2013

(87) PCT Pub. No.: WO2012/093648
PCT Pub. Date: Jul. 12, 2012

(65) Prior Publication Data

US 2013/0270078 A1 Oct. 17, 2013

(30) Foreign Application Priority Data

Jan. 5, 2011 (JP) ..... 2011-000692

(51) Int. Cl.
*H01H 1/44* (2006.01)
*H01H 23/12* (2006.01)
(Continued)

(52) U.S. Cl.
CPC ..... *H01H 23/12* (2013.01); *H01H 1/44* (2013.01); *H01H 23/145* (2013.01); *H01H 23/162* (2013.01)

(58) Field of Classification Search
CPC ..... H01H 1/44; H01H 23/12; H01H 23/162
USPC ..... 200/547, 549, 16 R, 252, 257, 16 D
See application file for complete search history.

(56) References Cited

U.S. PATENT DOCUMENTS 5,051,549 A * 9/1991 Takano ..... 200/16 C
5,365,028 A * 11/1994 Takano ..... 200/547
5,824,977 A * 10/1998 Takano et al. ..... 200/16 C
(Continued)

FOREIGN PATENT DOCUMENTS

CN 1122947 A 5/1996
CN 102971818 A 3/2013
(Continued)

OTHER PUBLICATIONS

Notification of Reasons for Refusal for Japanese Patent App. No. 2011-000692 (Sep. 24, 2014) with English translation thereof.
(Continued)

*Primary Examiner* — Kyung Lee
(74) *Attorney, Agent, or Firm* — Kenealy Vaidya LLP

(57) ABSTRACT

A switch device includes a busbar, a switch knob, a movable contact sliding part in the busbar, a movable contact configured to slide while elastically contacting the movable contact sliding part, root parts in the movable contact sliding part, and a fixed contact. The root parts are engaged with the movable contact. An engaging position of the movable contact is shifted from the one of the root parts to another one so as to switch connecting relation. A groove part and a rib are formed in the busbar between the one of the root parts and another one of the root parts. The rib is configured to abut against the movable contact to deform the movable contact in an opposite direction to a direction where the movable contact is engaged with the root parts, in a state where the movable contact is positioned at the groove part.

3 Claims, 18 Drawing Sheets

(51) Int. Cl.
*H01H 23/16* (2006.01)
*H01H 23/14* (2006.01)

(56) References Cited

U.S. PATENT DOCUMENTS

| | | | | |
|---|---|---|---|---|
| 6,841,749 | B1 * | 1/2005 | Radosavljevic et al. | 200/550 |
| 8,859,921 | B2 * | 10/2014 | Chiba | 200/547 |
| 2003/0159912 | A1 | 8/2003 | Sasaki | |
| 2005/0258023 | A1 | 11/2005 | Nagai et al. | |
| 2008/0302646 | A1 * | 12/2008 | Nagai et al. | 200/339 |
| 2013/0098747 | A1 | 4/2013 | Chiba | |

FOREIGN PATENT DOCUMENTS

| | | | |
|---|---|---|---|
| JP | 42-1072 | U | 1/1942 |
| JP | 57-101430 | U | 6/1982 |
| JP | 58-74725 | U | 5/1983 |
| JP | 61-99335 | U | 6/1986 |
| JP | 62-144017 | U | 9/1987 |
| JP | 2003-257270 | A | 9/2003 |
| JP | 2005-329884 | A | 12/2005 |
| JP | 2008-143213 | A | 6/2008 |
| WO | 02/103850 | A2 | 12/2002 |
| WO | 2012/002581 | A1 | 1/2012 |

OTHER PUBLICATIONS

International Search Report and Written Opinion of the International Search Report for PCT/JP2011/080588 dated Apr. 23, 2012.
Korean Office Action for the related Korean Patent Application No. 10-2013-7017770 dated Jun. 26, 2014.
Office Action from Chinese Patent App. No. 201180064383.3 (Nov. 24, 2014) with English language translation thereof.
Office Action from Korean Patent App. No. 10-2013-7017770 (Jan. 30, 2015) with English language translation thereof.

* cited by examiner

SWITCH DEVICE

TECHNICAL FIELD

The present invention is related to a switch device which is used for a room illuminating apparatus for a vehicle, and more particularly, is related to the switch device in which a busbar for wiring is used as a fixed contact.

BACKGROUND ART

As the switch device which is used for this purpose, there is, for example, a switch device of seesaw type as disclosed in PTL 1. FIG. 18 shows an example of the switch device of the seesaw type which is disclosed in PTL 1.

This switch device includes a functional part 102 having a bulb as a light source, and a switch lever 101 for connecting and disconnecting electric power to the bulb, and a decorative part 105 having a cover lens 103 covering the functional part 102, and a switch knob 104 for operating the switch lever 101. The switch lever 101 is mounted on the functional part 102 so as to swing, and the switch knob 104 is mounted on the decorative part 105 so as to swing. When the functional part 102 and the decorative part 105 are assembled together, a shaft part 106 which is a pivotal shaft of the switch lever 101 and a shaft part 107 which is a pivotal shaft of the switch knob 104 are aligned to be integrated. Accordingly, when the switch knob 104 is swung, the switch lever 101 swings thereby enabling the electric power to be connected or disconnected to the bulb. In this switch device of the seesaw type, a spring and a locking ball are used to give a feeling of click (switching feeling) to a user.

Moreover, there is such a switch device of sliding type that a sliding contact piece having a cantilever structure is slid along a printed board to be brought into contact with an electrically conductive pattern on the board (PTLs 2, and 3). Further, there is such a switch device of sliding type that a sheet of spring metal plate is folded in opposite directions, and slid along terminals in a zigzag shape which are arranged in parallel at an interval (PTL 4).

CITATION LIST

Patent Literature

[PTL 1] JP-A-2005-329884
[PTL 2] JP-UM-A-57-101430
[PTL 3] JP-UM A-62-144017
[PTL 4] JP-UM-A-58-74725

SUMMARY OF INVENTION

Technical Problem

In the switch device of the seesaw type which is exemplified in PTL 1, the feeling of click (switching feeling) is generally given to the user, by using the spring, the locking ball and so on. Therefore, a number of components is increased, and a number of assembling steps is also increased, resulting in an increase of cost.

Moreover, in the switch devices disclosed in PTLs 2 and 3, because a face plate as a movable contact is brought into contact with a fixed contact formed of a face plate, there is a limitation in enhancing contact reliability between the fixed contact and the movable contact.

Further, in the switch device disclosed in PTL 4, because a plurality of independent fixed contacts are arranged in parallel, the number of components is increased, and the number of assembling steps is also increased, resulting in an increase of cost.

It is therefore one advantageous aspect of the present invention to provide a switch device in which reduction of cost can be achieved by reducing the number of components and the number of assembling steps, and contact reliability between a fixed contact and a movable contact can be enhanced.

Solution to Problem

According to one advantage of the invention, there is provided a switch device comprising:

a main body provided with a busbar formed of electrically conductive material;

a switch knob which is provided in the main body so as to perform switching operation;

a movable contact sliding part which is provided in the busbar;

a movable contact, having elasticity, and configured to slide according to the switching operation of the switch knob while elastically contacting the movable contact sliding part;

a plurality of root parts, formed in the movable contact sliding part, configured to be engaged with the movable contact; and a fixed contact, formed of an end edge of the movable contact sliding part, and provided in one of the root parts, wherein an engaging position between the movable contact and the movable contact sliding part is shifted from the one of the root parts to another one of the root parts so as to switch connecting relation between the movable contact and the fixed contact, wherein a groove part is formed in the busbar between the one of the root parts and another one of the root parts which is adjacent to the one of the root parts, and wherein a rib is provided between the one of the root parts and the another one of the root parts which is adjacent to the one of the root parts, wherein the rib is configured to abut against the movable contact to deform the movable contact in an opposite direction to a direction where the movable contact is engaged with the root parts, in a state where the movable contact is positioned at the groove part.

The movable contact may have a cantilever shape extended from the switch knob, and the rib may project from the groove part toward an opposite side of the switch knob.

The rib may project toward an opposite direction to a direction where the movable contact is engaged with the root parts.

Advantageous Effects of Invention

According to the switch device of the present invention, a part of the end edge of the busbar is used as the fixed contact, and the movable contact is adapted to come into contact with the end edge. Therefore, dust or foreign substance is unlikely to enter between the fixed contact and the movable contact, and reliability of contact between the fixed contact and the movable contact can be enhanced. Moreover, the root parts and the peak parts are provided in the movable contact sliding part of the main body, and the movable contact having the spring characteristics is allowed to slide along the movable contact sliding part having the root parts and the peak parts. Therefore, it is possible to operate the switch knob with a feeling of click (switching feeling) with a simple structure, without using a spring or a locking ball. As the results, the number of components and assembling steps are reduced, and reduction of the cost can be achieved. In addition, in case where the groove part is formed between the root part where the fixed contact is provided and the adjacent root part, the rib is abutted against the movable contact positioned in the groove part thereby to press the movable contact in the opposite direction to the direction where the movable contact is engaged with the root part. Accordingly, it is possible to prevent the movable contact from being caught in the groove part. As the results, the switching feeling can be further improved, and occurrence of a switching error can be depressed.

According to the switch device of the present invention, the rib can be contacted with the movable contact at more open side of the movable contact. As the results, a force required for enabling the movable contact to override the rib, that is, a force required for the switching operation of the switch knob can be decreased. Moreover, because a large load is not imposed on the movable contact, deformation of the movable contact can be prevented.

According to the switch device of the present invention, it is possible to prevent the movable contact from being caught in the groove part, without upsizing the switch device.

According to the invention, it is possible to enhance contact reliability between the fixed contact and the movable contact, and at the same time, to operate the switch knob with a good feeling of click with the simple structure. Therefore, the number of components and assembling steps can be reduced, and reduction of the cost can be achieved.

DESCRIPTION OF EMBODIMENTS

A room illuminating apparatus for a vehicle ceiling including a switch device in an embodiment of the invention will be described.

Figure 1:
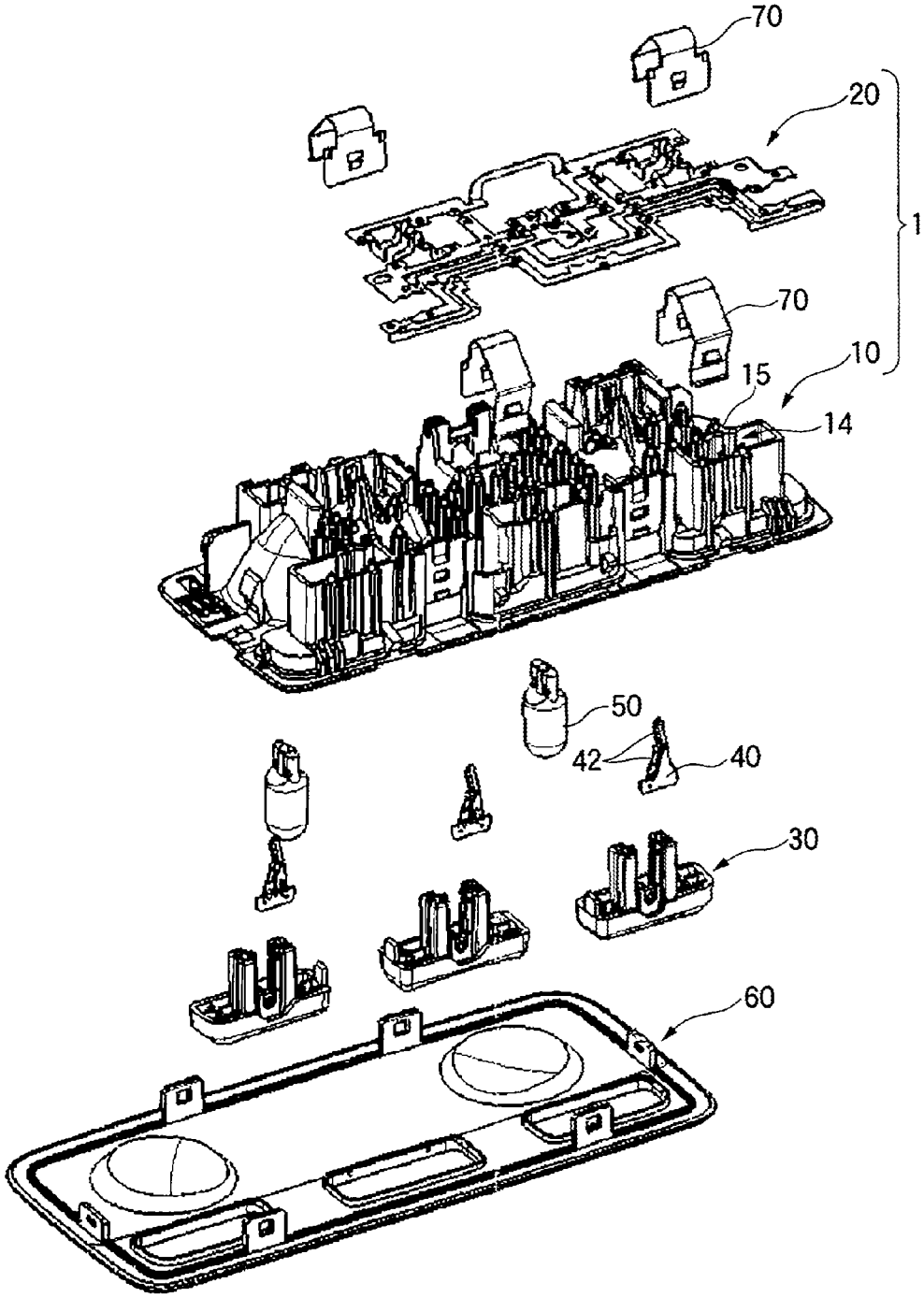
FIG. 1 is an exploded perspective view of a room illuminating apparatus for a vehicle ceiling including a switch device according to an embodiment of the invention.

FIG. 1 is an exploded perspective view of the room illuminating apparatus for a vehicle ceiling.

As shown in FIG. 1, this room illuminating apparatus for a vehicle ceiling has a main body 1 as a functional part, and a cover 60 provided with lenses as a decorative part. The main body 1 and the cover 60 with the lenses are attached to a ceiling part of a vehicle, keeping a vertical direction as shown in FIG. 1. Therefore, in this specification, the vertical direction is defined following the direction in FIG. 1. The main body 1 is provided with a housing 10 formed of insulating resin, and a busbar 20 formed of a electrically conductive material such as a metal plate. Switch knobs 30 and bulbs 50 are mounted on the housing 10, and contact members 40 are respectively fitted to the switch knobs 30. Moreover, metal dips 70 for fixing the room illuminating apparatus for a vehicle ceiling to a ceiling board of the vehicle are attached to a side part of the housing 10.

Figure 2A:
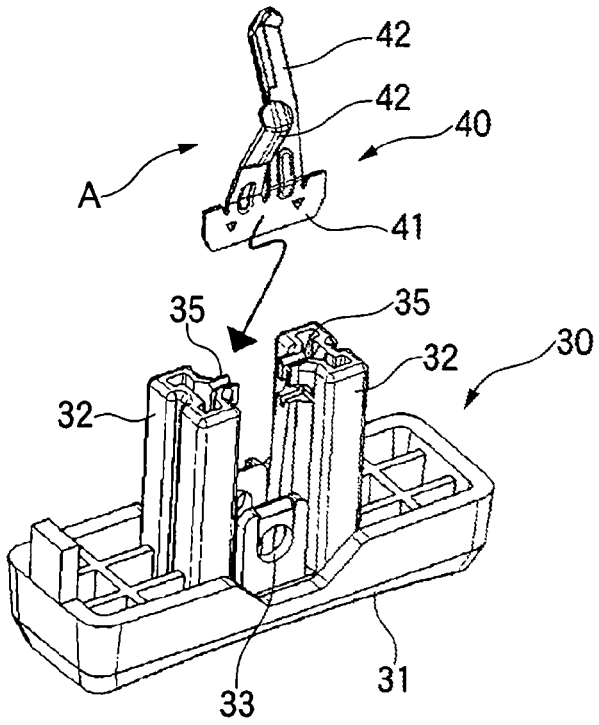
FIG. 2A is a perspective view showing relation between a switch knob which is an essential part of the switch device and a contact member, before the switch knob and the contact member are assembled together.
Figure 2B:
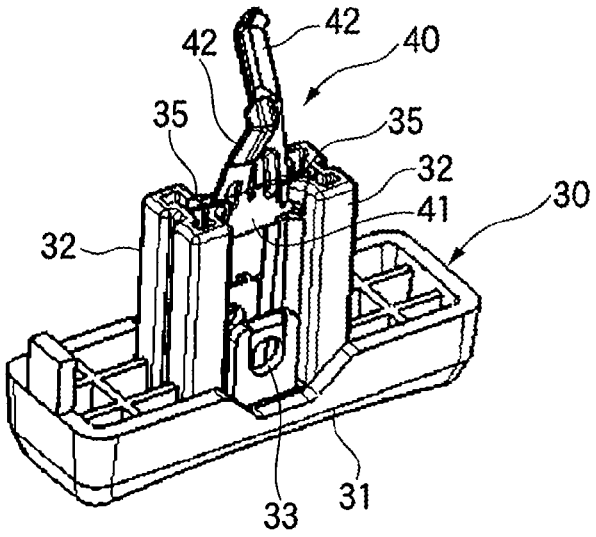
FIG. 2B is a perspective view of the same, after they have been assembled.

FIG. 2A is a perspective view showing relation between the switch knob which is an essential part of the switch device and the contact member, before the switch knob and the contact member are assembled together, and FIG. 2B is a perspective view of the same, after they have been assembled.

This switch knob 30 is a switch knob of seesaw type, and has an operating part 31 in a shape of a rectangular plate, a pair of support posts 32 which are uprightly provided on a back face of the operating part 31, pivot holes 33 which are provided in projecting pieces erected between the support posts 32, and mounting grooves 35 which are formed on opposed inner side faces of the support posts 32. The contact member 40 is formed by stamping a sheet of metal plate, and has a base board part 41 in a shape of a flat plate, two arm springs 42 in a cantilever shape projected from the base board part 41. In other words, the two arm springs 42 have the cantilever shape extended from the switch knob 30. The two arm springs 42 are offset in position in a longitudinal direction of the base board part 41. The longitudinal direction of the base board part 41 is identical to a sliding direction of the contact member 40 which will be described below. As seen from a direction of an arrow mark A in FIG. 2A, the two arm springs 42 extend in a V-shape on the base board part 41, and respective distal ends of the arm springs 42 are bent inward in a V-shape. These two arm springs 42, which function as movable contacts, are formed in a shape of a bar having a zigzag sectional shape of which outer side faces are convex so as to be engaged with a root part 14*a*, which will be described below. The contact member 40 is integrally attached to the back face of the switch knob 30, by press-fitting both side edges of the base board part 41 into the mounting grooves 35 in the support posts 32 of the switch knob 30.

Figure 3A:
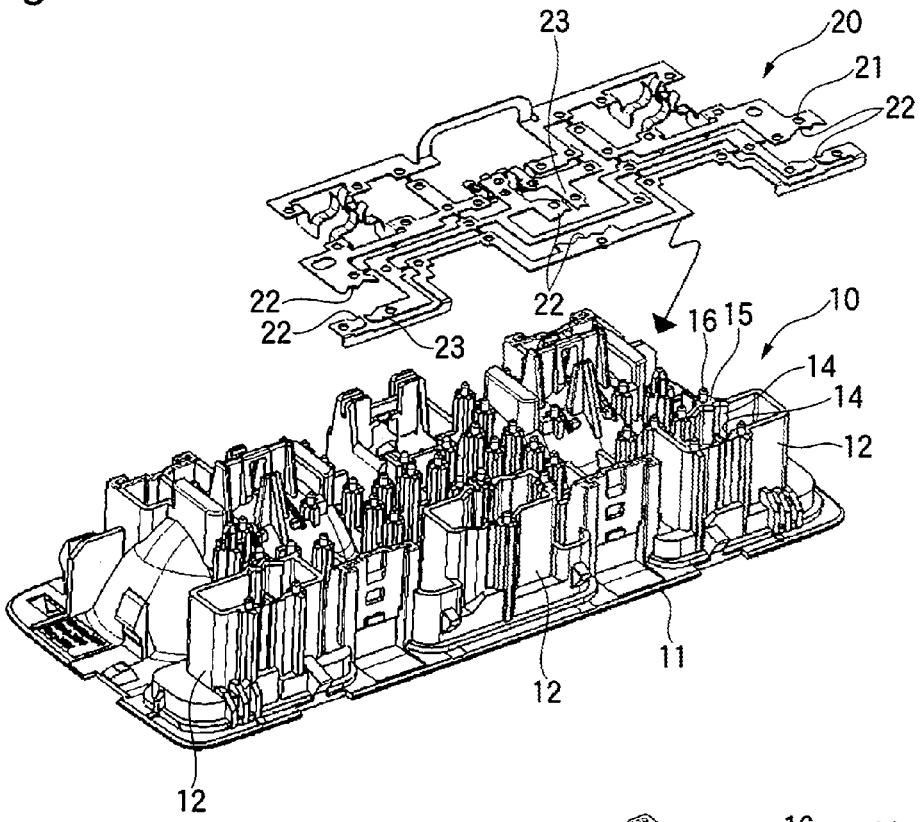
FIG. 3A is a perspective view showing relation between a housing of the room illuminating apparatus for a vehicle ceiling and a busbar, before the busbar is assembled to a back face of the housing.
Figure 3B:
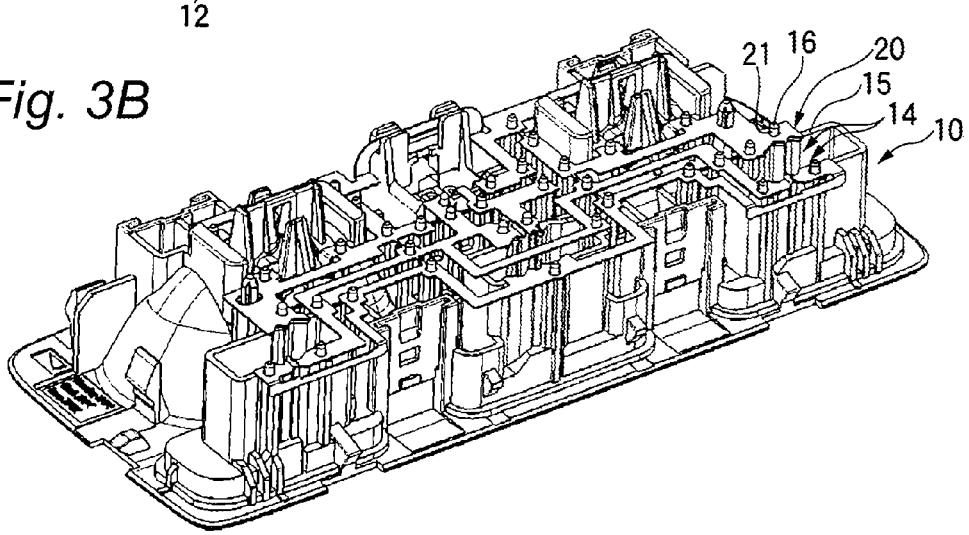
FIG. 3B is a perspective view of the same, after the busbar has been assembled to the back face of the housing.
Figure 7:
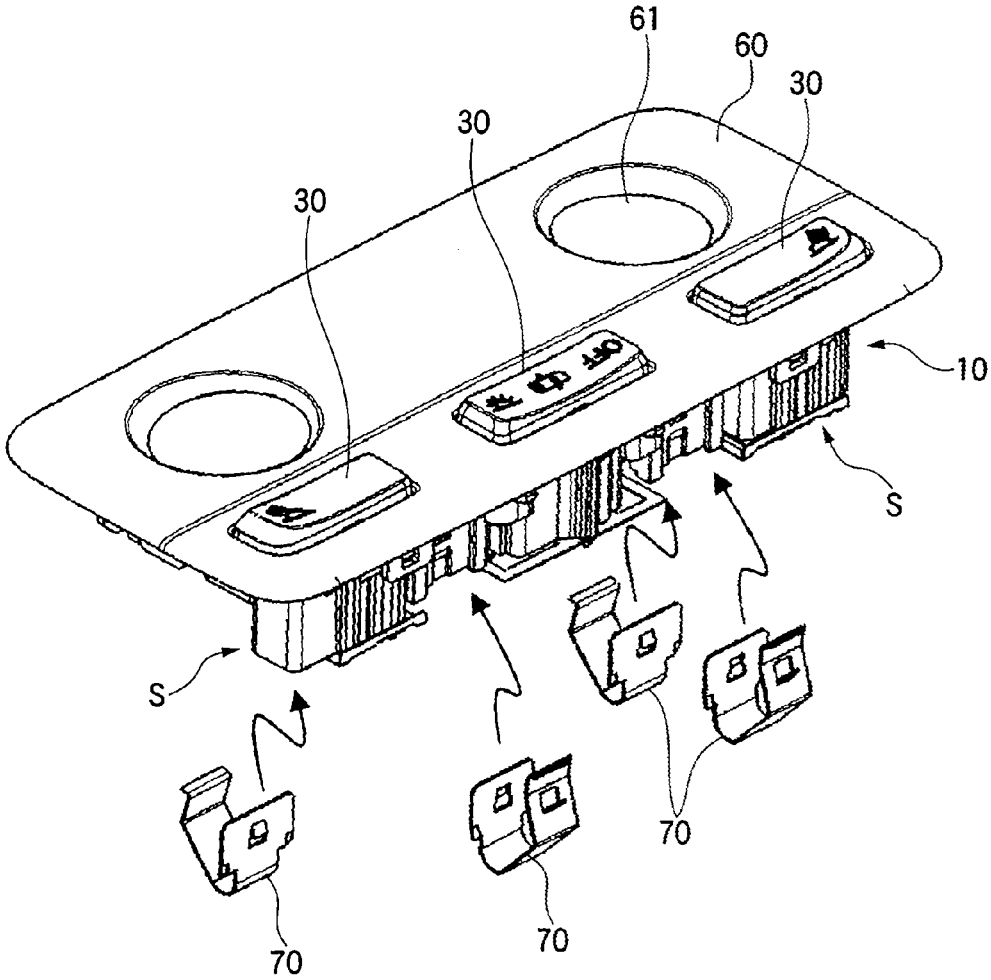
FIG. 7 is a perspective view showing a state where metal clips are being attached to the housing, after the cover provided with the lenses has been mounted on the housing.
Figure 8A:
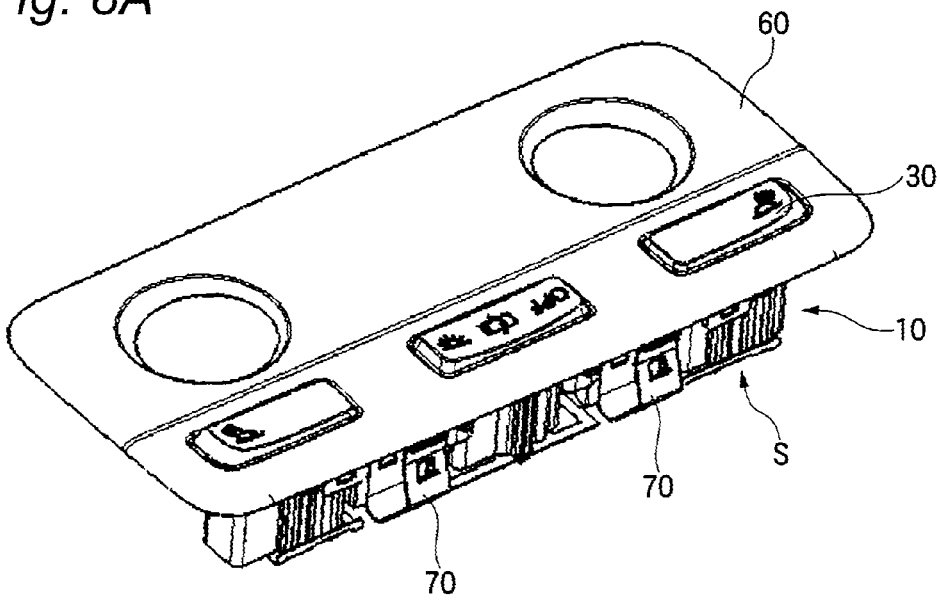
FIG. 8A is a perspective view showing a structure of the room illuminating apparatus for a vehicle ceiling which has been assembled, as seen from a front side.
Figure 8B:
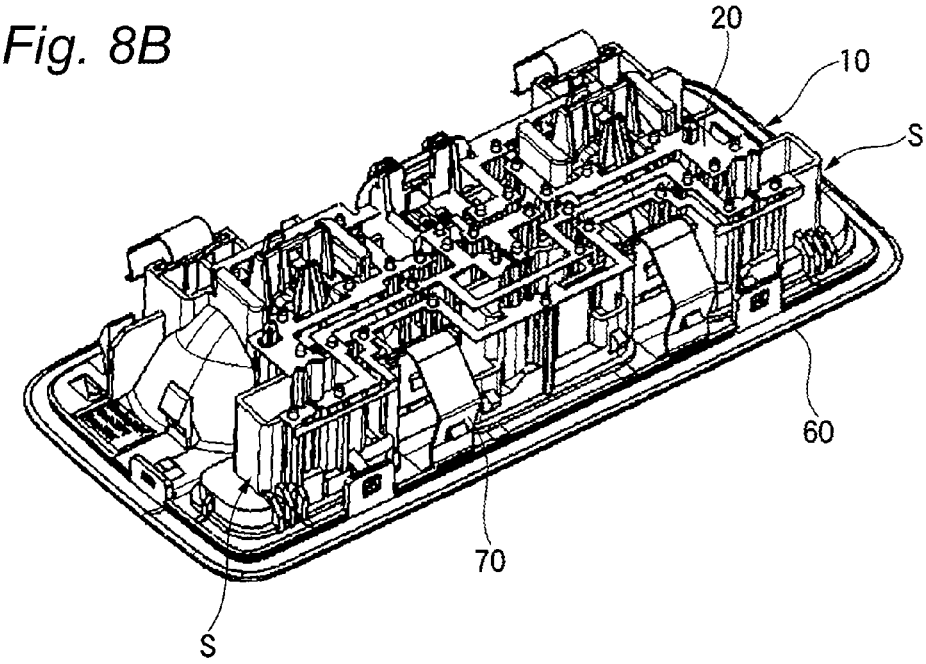
FIG. 8B is a perspective view of the same, as seen from a back side.
Figure 10A:
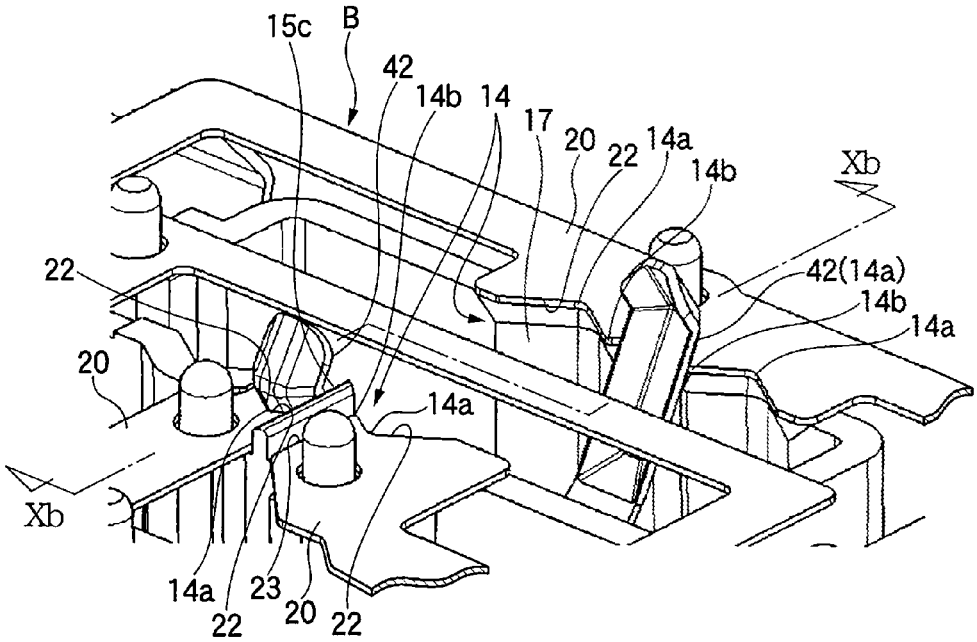
FIG. 10A is a perspective view showing a state where an arm spring of a contact member side is added to the structure of the fixed contact side.
Figure 10B:
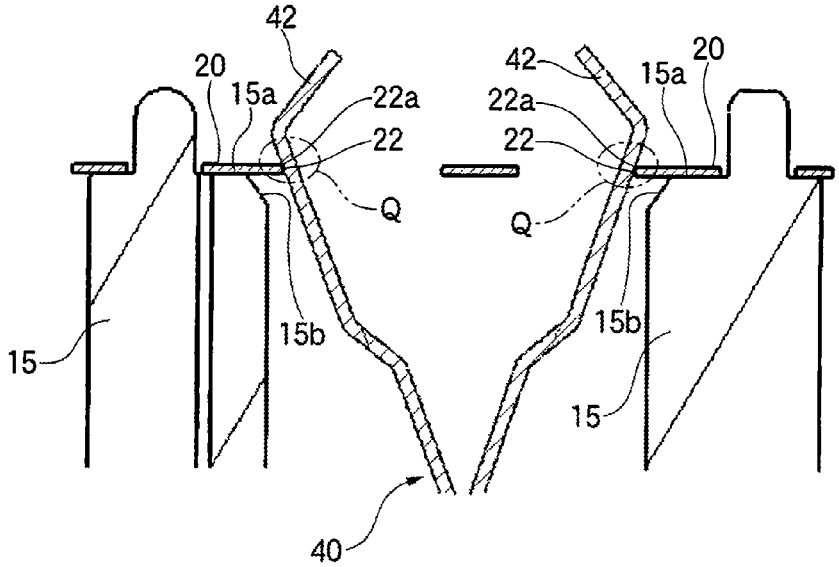
FIG. 10B is a sectional view of the same, as seen from a direction of arrow marks Xb-Xb in FIG. 10A.
Figure 11A:
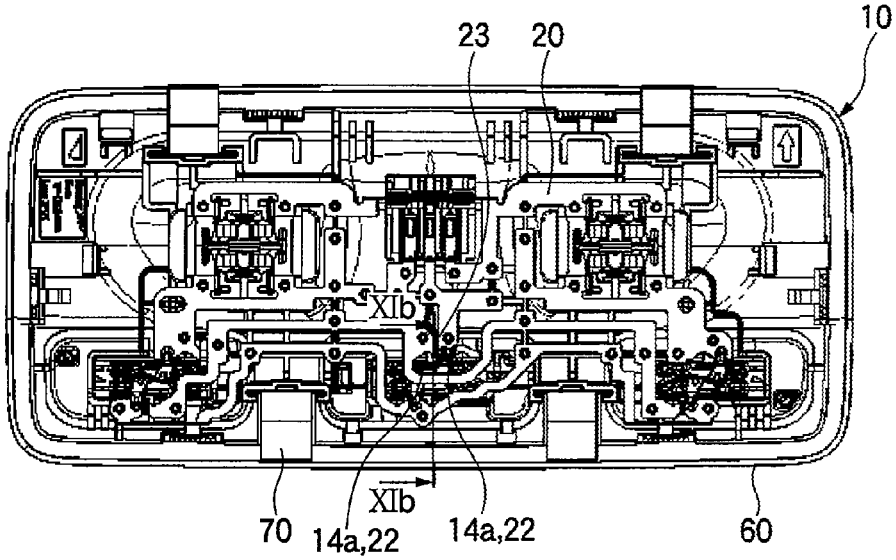
FIG. 11A is a back view of the room illuminating apparatus for a vehicle ceiling.
Figure 11B:
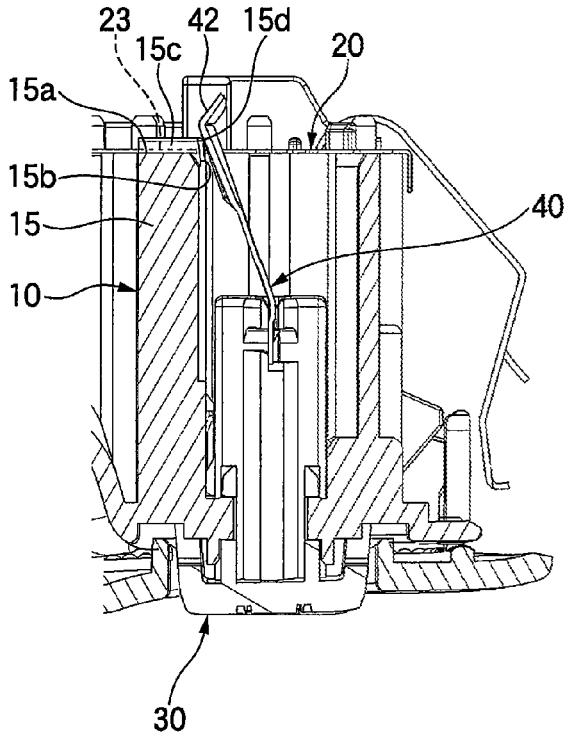
FIG. 11B is a sectional view of the same, as seen from a direction of arrow marks XIb-XIb in FIG. 11A.
Figure 12:
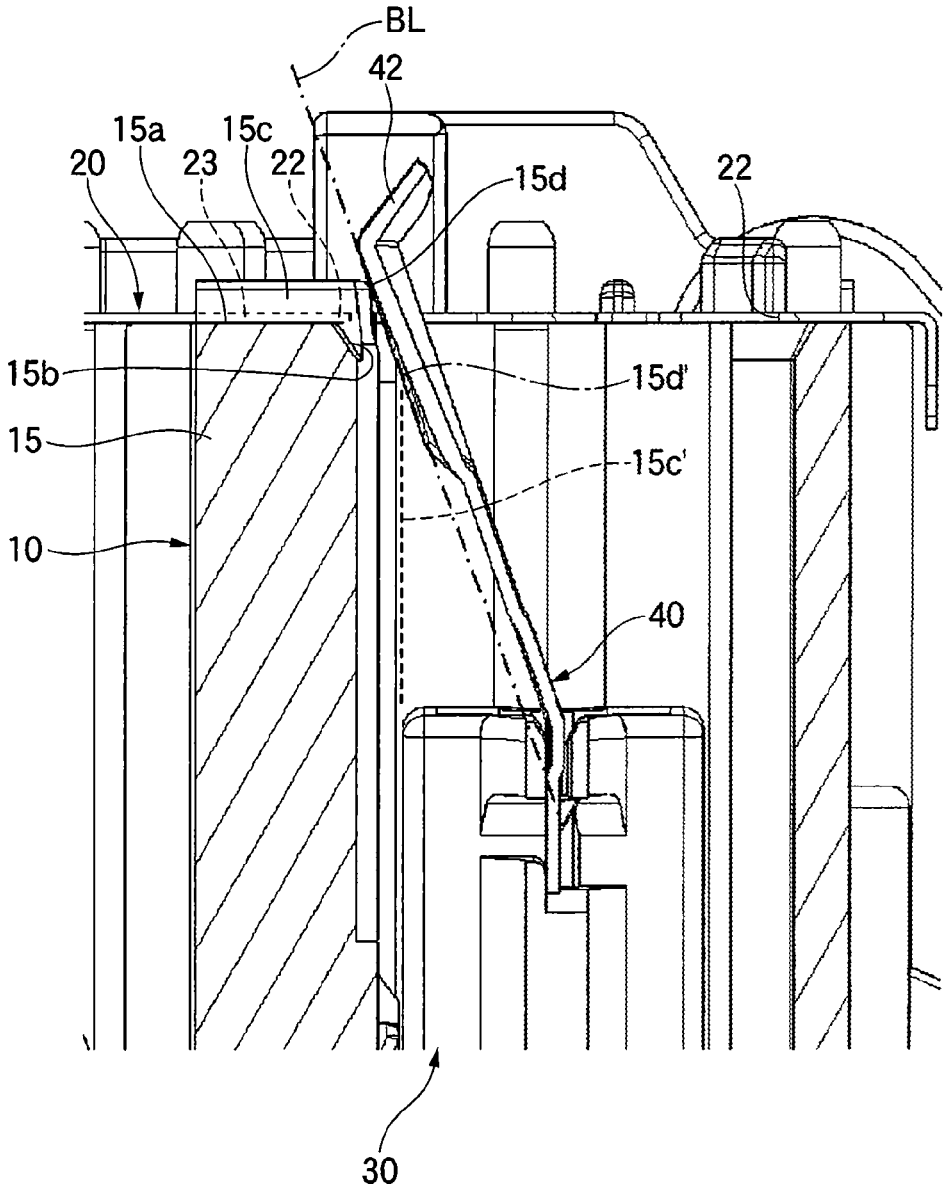
FIG. 12 is an enlarged sectional view of a part in FIG. 11B.
Figure 13:
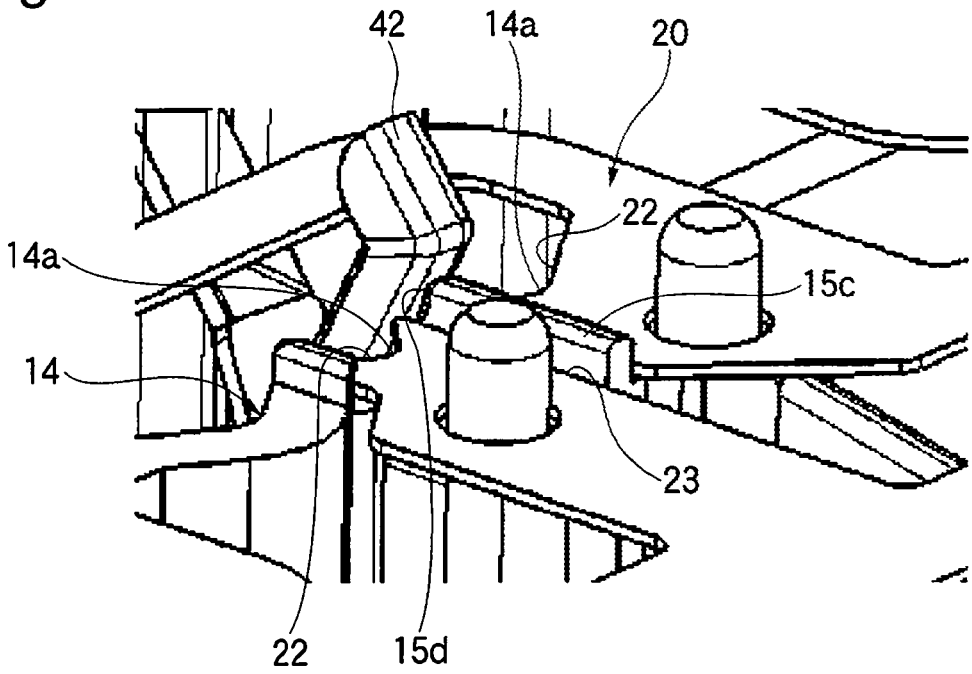
FIG. 13 is a perspective view showing the structure of the fixed contact side, which is the essential part of the switch device in the embodiment.
Figure 14A:
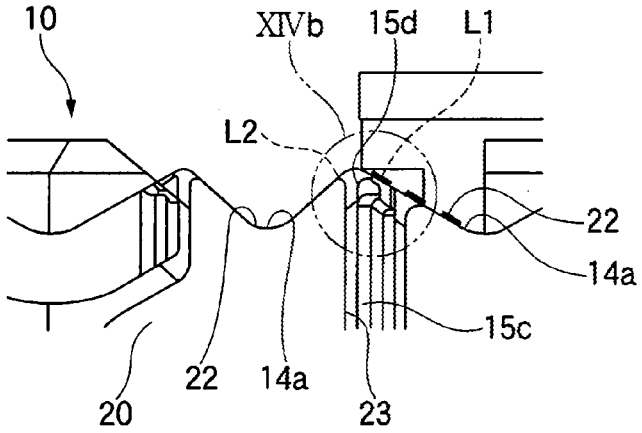
FIG. 14A is an enlarged plan view showing a part of the structure of the fixed contact side, which is the essential part of the switch device in the embodiment.
Figure 14B:
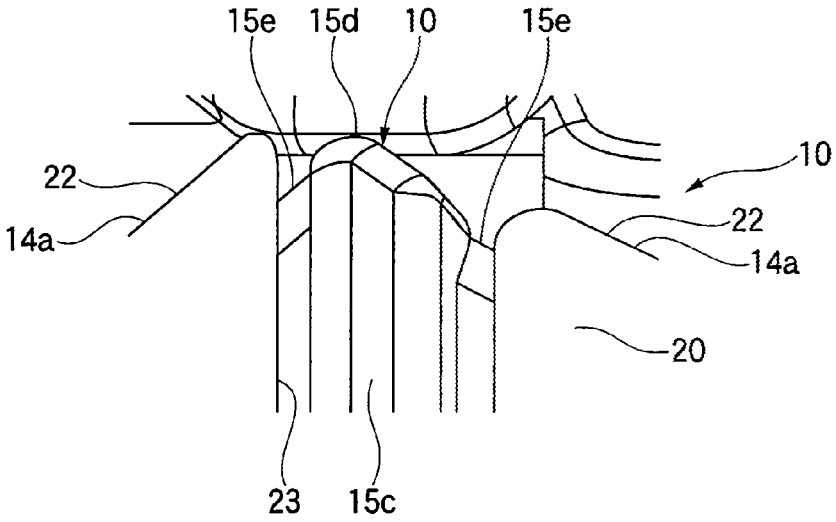
FIG. 14B is an enlarged plan view of a part XIVb in FIG. 14A.
Figure 15:
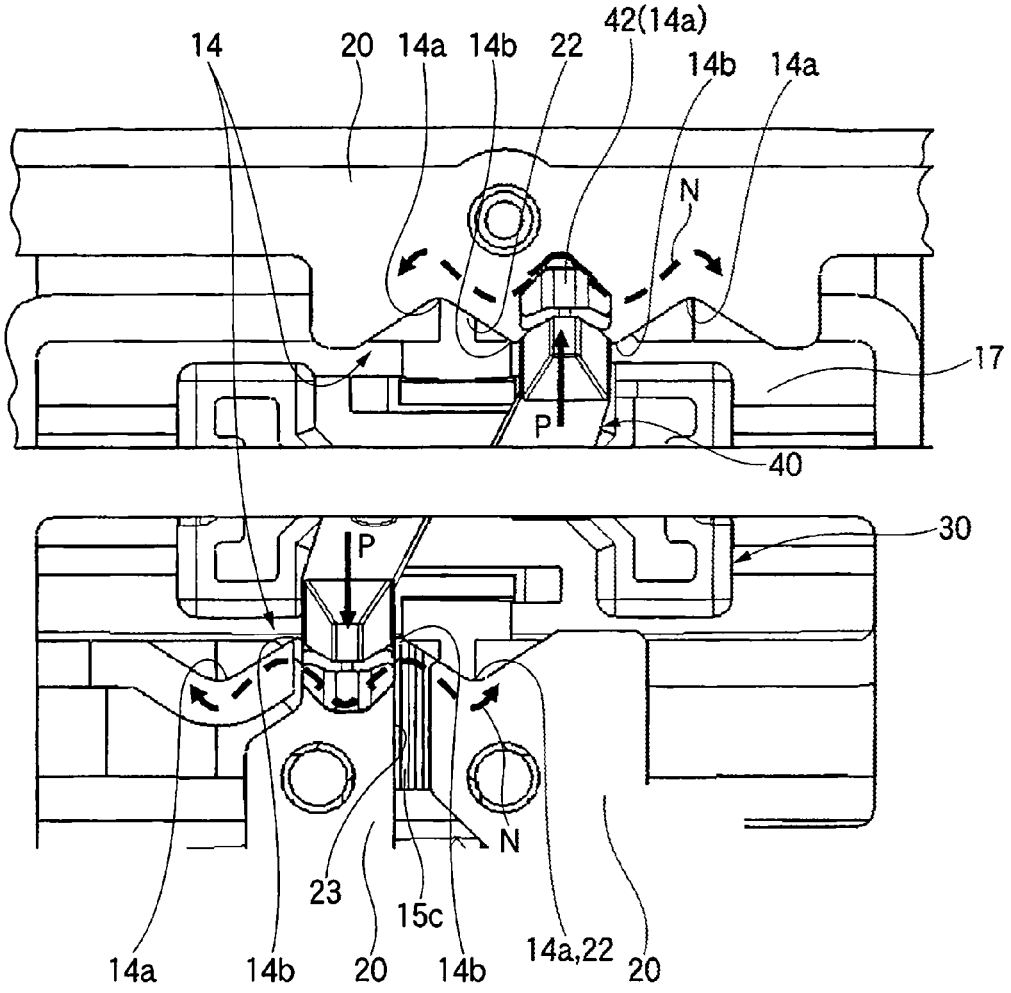
FIG. 15 is a plan view of a part which is shown in FIG. 10.
Figure 16:
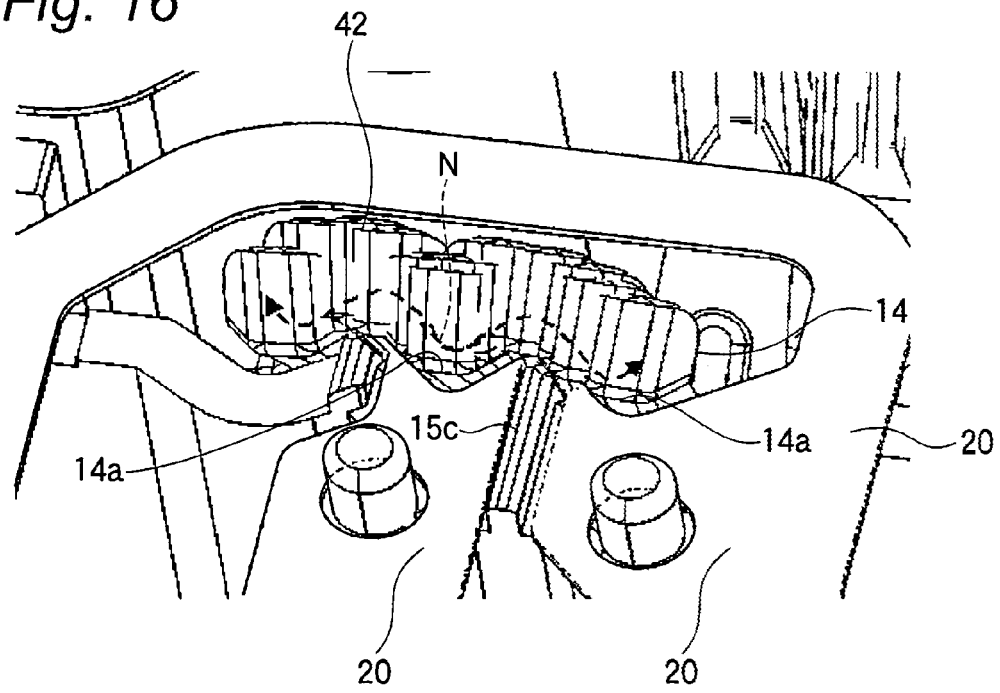
FIG. 16 is a perspective view of a part which is shown in FIG. 13.

FIG. 3A is a perspective view showing relation between the housing 10 and the busbar 20 in the room illuminating apparatus for a vehicle ceiling, before the busbar 20 is assembled to a back face of the housing 10, and FIG. 3B is a perspective view of the same, after the busbar 20 has been assembled to the back face of the housing 10. FIGS. 4 to 7 are views showing assembling steps of the room illuminating apparatus for a vehicle ceiling, and FIG. 8 is a view showing the room illuminating apparatus for a vehicle ceiling, after it has been completed. FIG. 9 is a perspective view showing a structure of a side of a fixed contact, which is an essential part of the switch device, FIG. 10 is a perspective view showing a state where an arm spring of a contact member side is added to the structure of the fixed contact side, FIG. 11A is a back view of the room illuminating apparatus for a vehicle ceiling, and FIG. 11B is a sectional view of the same, as seen from a direction of arrow marks XIb-XIb in FIG. 11A, FIG. 12 is an enlarged sectional view of a part in FIG. 11B, FIG. 13 is a perspective view showing the structure of the fixed contact side, which is the essential part of the switch device in the embodiment, FIG. 14 is an enlarged plan view showing a part of the structure of the fixed contact side, which is the essential part of the switch device in the embodiment, FIG. 14B is an enlarged plan view of a part XIVb in FIG. 14A, FIG. 15 is a plan view of a part which is shown in FIG. 10, and FIG. 16 is a perspective view of a part which is shown in FIG. 13.

A required number of tube parts 12 in a rectangular shape for composing the switch device S are provided on a back face of a base board 11 of the housing 10. The required number of the tube parts 12 is three in this embodiment. The back face becomes an upper face, when the housing 10 is attached to a vehicle. In addition to the tube parts 12, busbar supporting parts 15 for supporting the busbar 20 are provided on the back face of the base board 11. The busbar 20 in which a plurality of lines are prepared is placed on upper faces of the busbar supporting parts 15 so that the lines may not interfere with each other, and fixed to the housing 10 by heat welding pins 16 of the housing 10, after the pins 16 are passed through fixing holes 21 of the busbar 20.

Each of the tube parts 12 of the housing 10 is provided, on its opposed inner side faces, with movable contact sliding parts 14 for allowing the arm springs 42, as the movable contacts, to slide along, keeping elastic contact with the movable contact sliding parts 14. The two arm springs 42 are inserted into a sliding space 17 between the movable contact sliding parts 14 which are arranged so as to be opposed, so that the arm springs 42 can slide with respect to the movable contact sliding parts 14. The arm springs 42 are adapted to slide along the movable contact sliding parts 14 following switching operation of the switch knob 30. Strictly, each of the arm springs 42 slides along an arc around the pivot hole 33 which is a pivotal point.

Figure 9A:
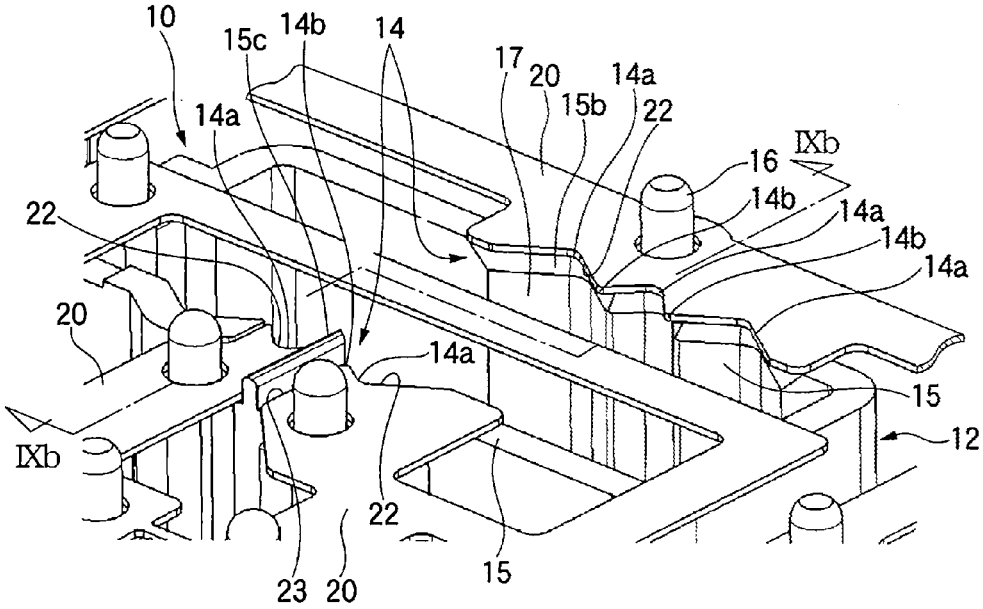
FIG. 9A is a perspective view showing a structure of a side of a fixed contact which is an essential part of the switch device in the embodiment.

As shown in FIG. 9A, the movable contact sliding parts 14 are opposed to each other, interposing the sliding space 17. The opposed movable contact sliding parts 14 are provided with a plurality of the root parts 14*a* which the arm springs 42, as the movable contacts, can be selectively engaged with, and peak parts 14*b* are formed between the adjacent root parts 14*a*. Moreover, fixed contacts 22 formed of end edges of the busbar 20 are respectively disposed, specifically, in the two adjacent root parts 14*a* of at least one of the opposed movable contact sliding parts 14. The end edges of the busbar 20 which form these fixed contacts 22 also correspond to the movable contact sliding parts 14. These movable contact sliding parts 14 at a side of the busbar 20 are also provided with the root parts 14*a* and the peak parts 14*b* corresponding to the root parts 14*a* and the peak parts 14*b* at a side of the hosing 10. Moreover, in order to separate the adjacent fixed contacts 22, there is formed a groove part 23 between them. In other words, the groove part 23 is formed between the root part 14*a* where the fixed contact 22 is provided and the root part 14*a* adjacent thereto where the fixed contact 22 is provided. In this switch device S, when the arm springs 42 slide, engaging positions of the arm springs 42 are switched from one of a plurality of the root parts 14*a* to the other root part 14*a*, and thus, connecting relation between the arm springs 42, as the movable contacts, and the fixed contacts 22 are switched.

Figure 9B:
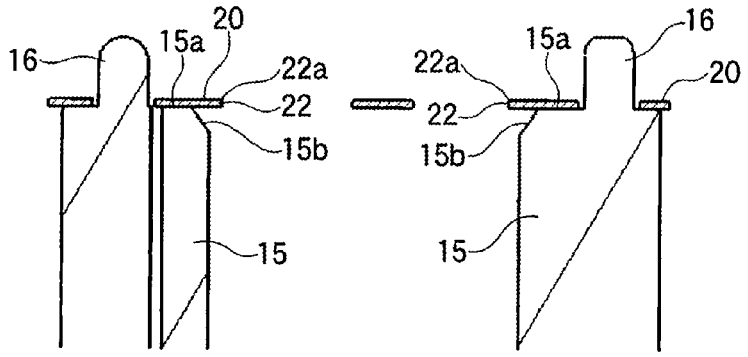
FIG. 9B is a sectional view of the same, as seen from a direction of arrow marks IXb-IXb in FIG. 9A.

As shown in FIG. 9B, cut-outs 15*b* are provided at respective corner parts of upper faces 15*a* of the busbar supporting parts 15, thereby allowing the end edges of the busbar 20 as the fixed contacts 22 to project outward from the busbar supporting parts 15. As shown in FIG. 10, the arm springs 42 as the movable contacts are disposed so as to extend in a direction perpendicular to a plate face of the busbar 20, and inclined in such a manner that their outer side faces may be abutted against upper edges 22*a* of the fixed contacts 22.

As shown in FIG. 11A, the groove part 23 between the adjacent fixed contacts 22 extends in a direction where the movable contact sliding part 14 is concaved, that is, an engaging direction of the arm spring 42. As shown in FIGS. 11B, 12 and 13, a rib 15*c* is uprightly provided on the housing 10 at a position of the groove part 23. This rib 15*c* also extends along the direction where the movable contact sliding part 14 is concaved, that is, the engaging direction of the arm spring 42. The rib 15*c* is projected from the busbar 20 in a direction of a thickness of the busbar toward an open end side of the arm spring 42 having a cantilever shape. In other words, the rib 15*c* projects from the groove part 23 toward an opposite side of the switch knob 30. A guide part 15*d* is formed at a projecting tip end of the rib 15*c* at a side opposed to the arm spring 42. The rib 15*c* comes into point contact with the arm spring 42 at a position of this guide part 15*d*, thereby to guide sliding movement of the arm spring 42, by displacing a position of the point contact. A part of the rib 15*c* at the side opposed to the arm spring 42 is slightly inclined so as to be positioned close to the arm spring 42 in the extending direction of the groove part 23, as going near a base end side in the projecting direction of the rib 15*c*.

As shown in FIG. 14A, one side of the guide part 15*d* of the rib 15*c* is continued to one of the root parts 14*a* which is separated by the groove part 23, and guides the arm spring 42 to move on the same line L1. The opposite side of the guide part 15*d* is continued to the other root part 14*a* which is separated by the groove part 23, and guides the arm spring 42 to move on the same line L2.

As shown in FIG. 14B, the housing 10 is provided with groove parts 15*e* at positions corresponding to the groove parts 23 of the busbar 20. Specifically, the groove parts 15*e* are formed at both sides of a boundary between the housing 10 and the busbar 20. On the other hand, as shown in FIGS. 13 and 14B, the guide part 15*d* of the rib 15*c* is abutted against the arm spring 42 which is positioned in the groove part 23 of the busbar 20 and the groove part 15*e* thereby to press the arm spring 42 in an opposite direction to the direction where the arm spring 42 is engaged with the root part 14*a*. In this manner, the rib 15*c* restrains the arm spring 42 from entering into the groove part 23 of the busbar 20 and the groove part 15*e* of the housing 10 which exists inside this groove part 23.

In order to assemble this room illuminating device for a vehicle ceiling, as a first step, the contact member 40 is attached to the switch knob 30, by press-fitting both side edges of the base board 41 of the contact member 40 into the mounting grooves 35 of the support posts 32 on the back face of the switch knob 30, as shown in FIG. 2. Then, the busbar 20 is fixed to the housing 10, by placing the busbar 20 on the upper faces 15*a* of the busbar supporting parts 15 of the housing 10 (See FIG. 9), and heat welding the pins 16, as shown in FIG. 3.

Figure 4:
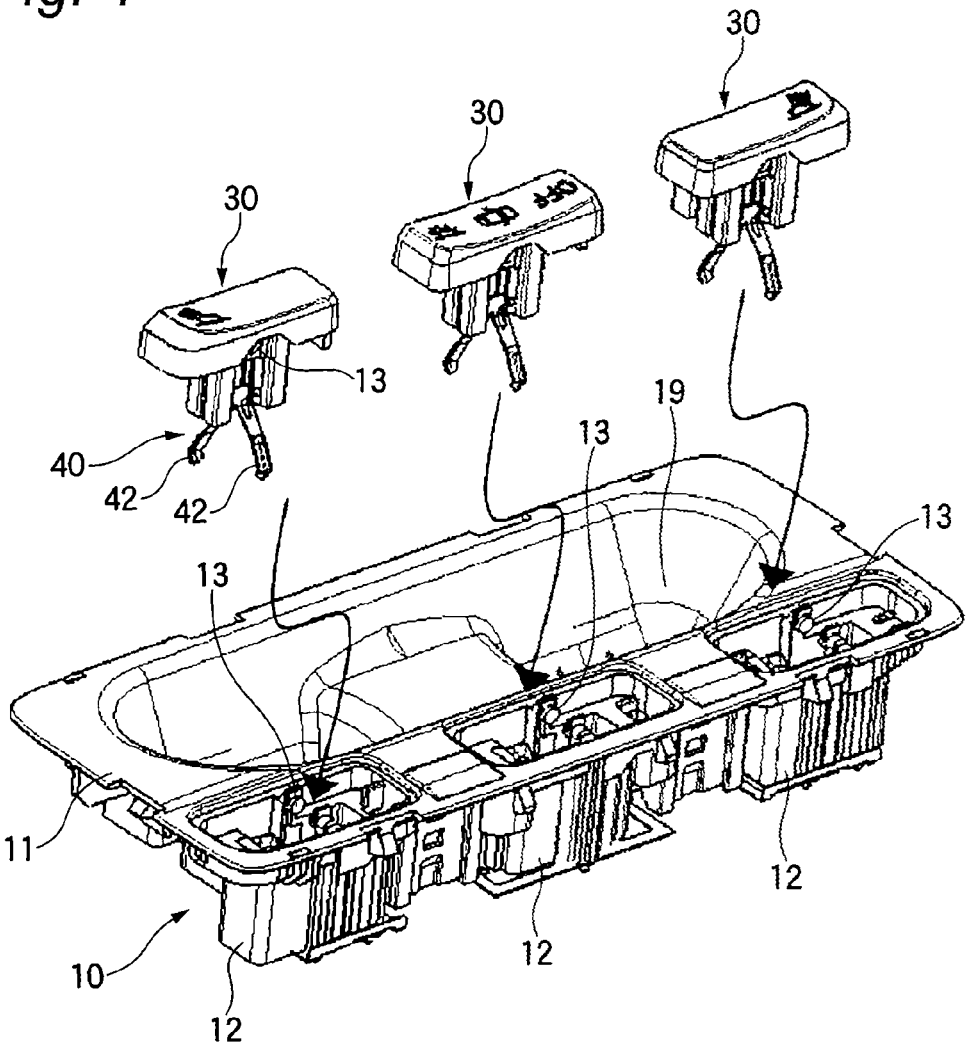
FIG. 4 is a perspective view showing a state where the switch knobs provided with the contact members are being assembled to the housing from a front face side, after the busbar has been assembled to the back face of the housing.
Figure 5:
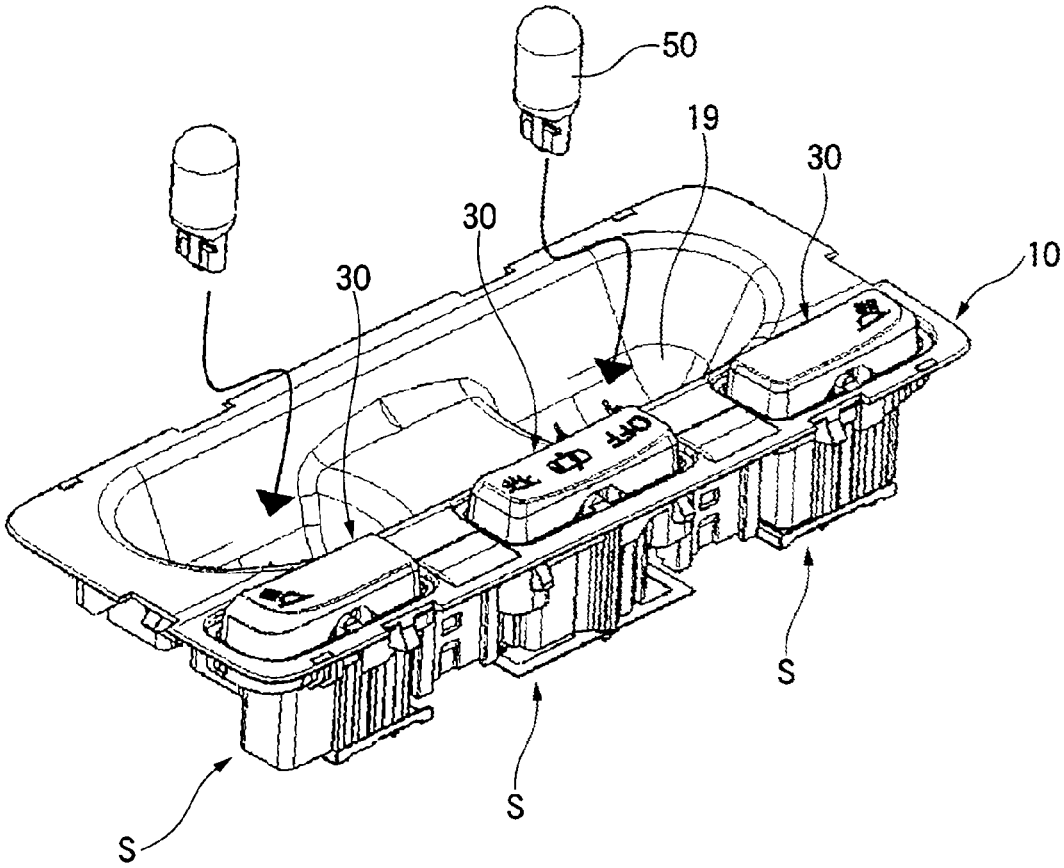
FIG. 5 is a perspective view showing a state where bulbs are being mounted to the housing, after the switch knobs provided with the contact members have been assembled to the housing.

Then, as shown in FIGS. 4 and 5, the switch knobs 30 are assembled to the housing 10 so as to swing, by mounting the switch knobs 30 inside the tube parts 12 of the housing 10, and inserting the pivot holes 33 over the pivotal convex parts (not shown) which are uprightly provided on the inner side faces of the tube parts 12. By assembling the switch knobs 30 in this manner, the two arm springs 42 of the contact member 40 are inserted into the sliding space 17 between the opposed movable contact sliding parts 14, as shown in FIG. 10, and the outer side faces of the arm springs 42 are slidably abutted against the movable contact sliding parts 14. On this occasion, the arm springs 42 are pressed with their own repulsive spring forces P to be contacted with the movable contact sliding parts 14, as shown in FIGS. 15 and 16. By assembling the switch knobs 30 in this manner, the switch device S is completed, and by pressing the operating parts 31 to swing the switch knobs, the switching operation can be performed.

Figure 6:
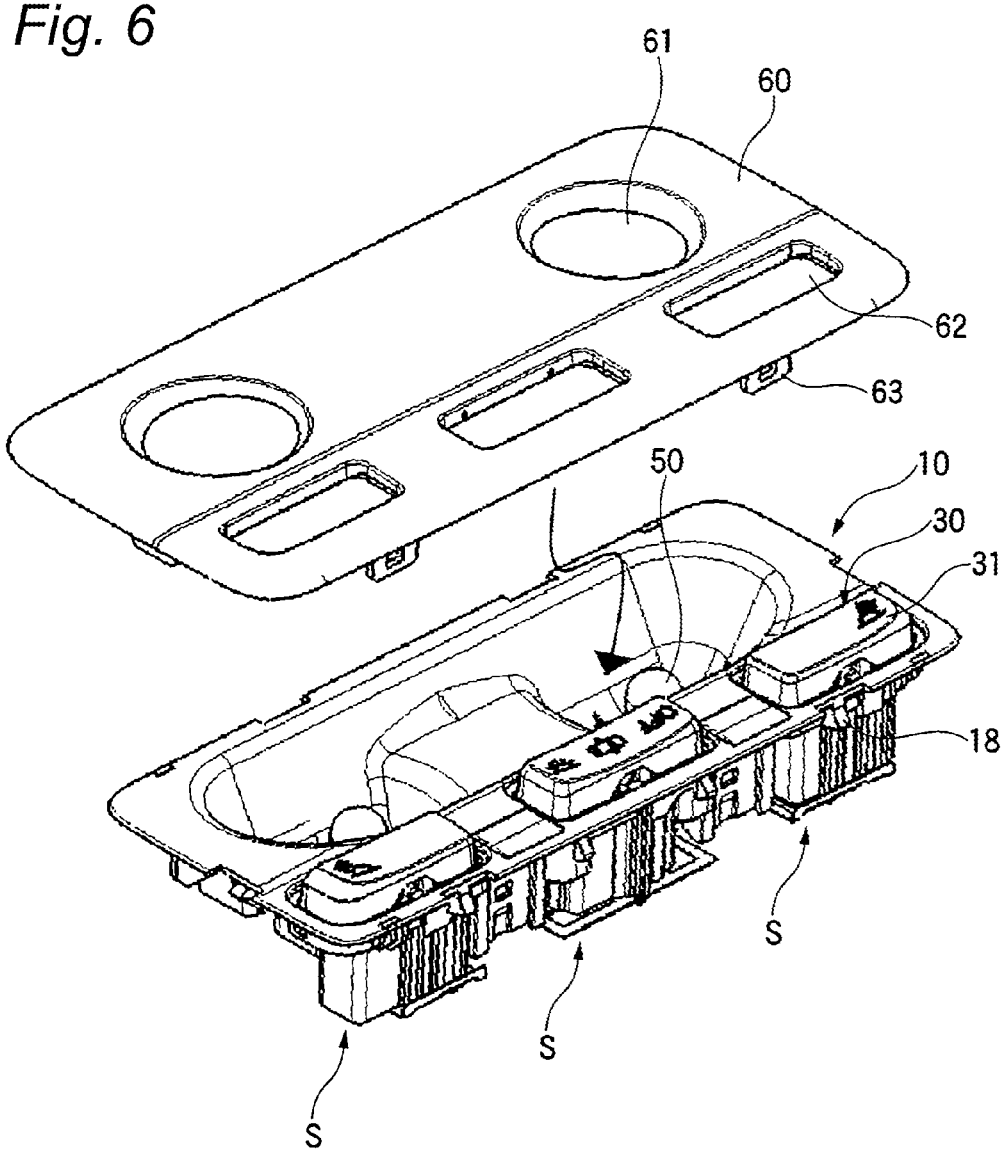
FIG. 6 is a perspective view showing a state where a cover provided with lenses is being mounted on the housing, after the bulbs have been assembled to the housing.

Then, the bulbs 50 are mounted on the bulb mounting part 19 of the housing 10, as shown in FIG. 5, and thereafter, the cover 60 with the lenses is mounted on the housing 10, as shown in FIG. 6, thereby allowing the lens parts 61 to be positioned in front of the bulbs 50. Moreover, switch openings 62 are aligned with the switch knobs 30 thereby to expose the operating parts 31 of the switch knobs 30 to the exterior. Then, the metal clips 70 are attached to the side parts of the housing 10 as shown in FIG. 7, and thus, the room illuminating device for a vehicle ceiling is completed.

Figure 17:
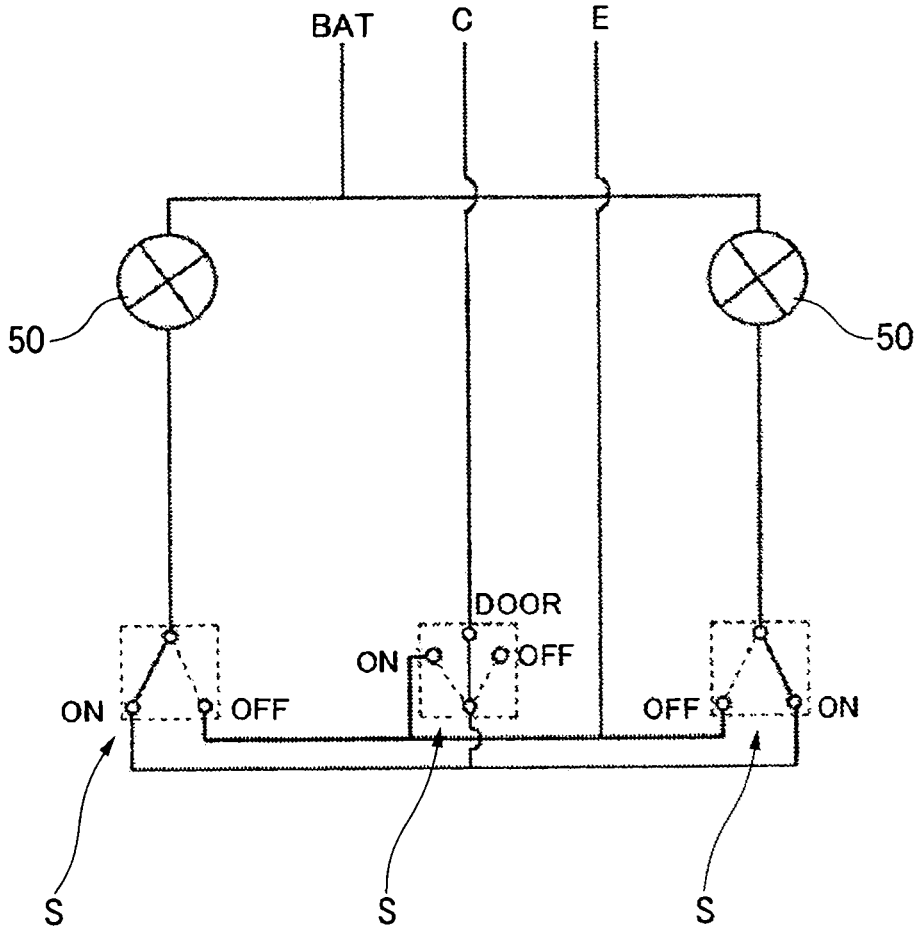
FIG. 17 is an electric circuit diagram of the room illuminating apparatus for a vehicle ceiling.
Figure 18:
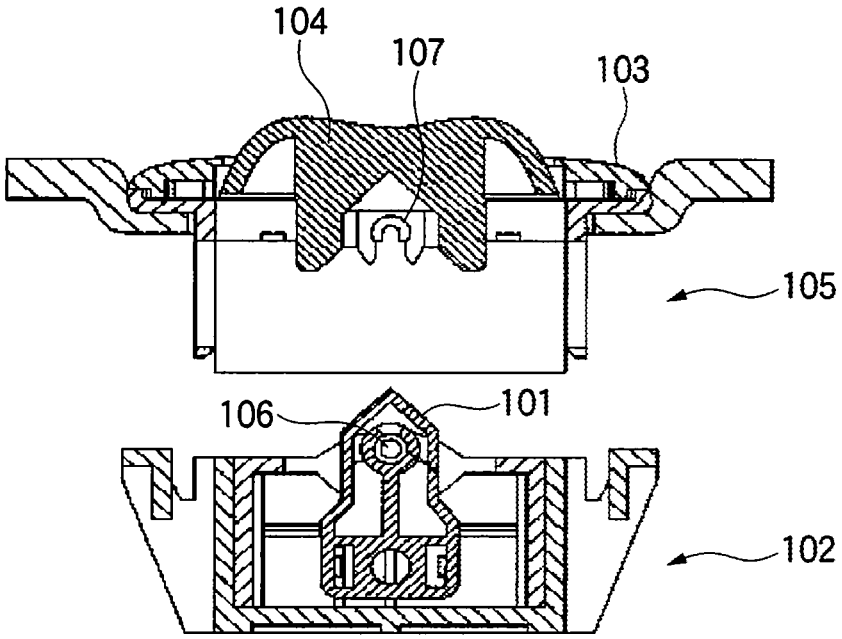
FIG. 18 is an exploded sectional view of a conventional switch device.

FIG. 17 is an electric circuit diagram of the room illuminating device for a vehicle ceiling which has been constructed as described above.

The switch devices S at both ends are of a type having the two fixed contacts, and the switch device S at the center is of a type having the three fixed contacts.

Now, operation of this room illuminating device for a vehicle ceiling will be described.

In the switch knob 30 of the switch device S, the arm springs 42 are elastically engaged with the root parts 14*a* of the movable contact sliding parts 14 thereby to be positioned at the predetermined positions. In a state where the arm springs 42 are positioned in the root parts 14*a* at a certain position, when the switch knob 30 is operated to shift the arm springs 42 to another position, the arm springs 42 override the peak parts 14*b* thereby to be elastically engaged with the adjacent root parts 14*a*. Because the engaging positions of the arm springs 42 are shifted, a contact state of the busbar 20 is switched.

On this occasion, the root parts 14*a* and the peak parts 14*b* are provided in the movable contact sliding parts 14, and the arm springs 42 having spring characteristics are allowed to slide along the movable contact sliding parts 14 having the root parts 14*a* and the peak parts 14*b*. Therefore, it is possible to operate the switch knob 30 with a feeling of click (switching feeling) with a simple structure, without using a spring, a locking ball, and so on which have been conventionally used. In short, because the arm springs 42 are slid along excursions in a zigzag shape as shown by dotted lines N in FIGS. 15 and 16, it is possible to create a good feeling of click. As the results, the number of components and assembling steps are reduced, and reduction of the cost can be achieved.

Moreover, as shown in FIG. 10, a part of the end edge of the busbar 20 is used as the fixed contacts 22, and the arm springs 42 which are the movable contacts are adapted to come into contact with the end edge. Therefore, dust or foreign substance is unlikely to enter between the fixed contacts 22 and the arm springs (movable contacts) 42, and reliability of contacts between the fixed contacts 22 and the arm springs (movable contacts) 42 can be enhanced.

Moreover, as shown in FIG. 13, when the arm spring 42 moves to and fro between the root parts 14*a* at the adjacent two positions which constitute the fixed contacts 22, at a time point of passing the groove part 23 between the fixed contacts 22, the rib 15*c* formed in the groove part 23 is abutted against the arm spring 42 thereby to press the arm spring 42 in the opposite direction to the engaging direction to be engaged with the movable contact sliding part 14. In this manner, the rib 15*c* restrains the arm spring 42 from entering into the groove part 23 of the busbar 20 and the groove part 15*e* of the housing 10 which is shown in FIG. 14B. Accordingly, it is possible to prevent the arm spring 42 from being caught in the groove part 23 and the groove part 15*e*. As the results, the switching feeling can be further improved, and at the same time, occurrence of a switching error can be depressed.

In this switch device S, as shown in FIG. 12, the rib 15*c* is projected from the groove part 23 of the busbar 20 toward the open side at the opposite side to the pivot of the arm spring 42 in a cantilever shape. In other words, the rib 15*c* projects toward an opposite direction to a direction where the arm spring 42 is engaged with the root parts 14*a*. Therefore, the rib 15*c* can be contacted with the arm spring 42 at more open side of the arm spring. As the results, a force required for enabling the arm spring 42 to override the rib 15*c*, that is, a force required for the switching operation of the switch knob 30 can be reduced. Moreover, because a large load is not imposed on the arm spring 42, deformation of the arm spring 42 can be prevented. In this case, the rib 15*c* can be only moved on an excursion along the root parts 14*a* at both sides of the groove part 23, without being caught in the groove part 23 and the groove part 15*e*. Therefore, the rib 15*c* has only to come into contact with the arm spring 42 on a basic line BL, as shown in FIG. 12. For example, the rib 15*c* may be projected toward the center between the opposed fixed contacts 22, in a shape of a rib 15*c*' as shown by a broken line in FIG. 12, and the arm spring 42 may be guided by a guide part 15*d*' at an upper end of this rib 15*c*'. In this case, it is possible to prevent the arm spring 42 from being caught in the groove part 23 and the groove part 15*e*, without upsizing the switch device.

Moreover, in this switch device S, the cut-outs 15*b* are provided at the respective corner parts of the upper faces 15*a* of the busbar support parts 15 of the housing 10 so that the end edge of the busbar 20 which forms the fixed contacts 22 may be projected outward of the busbar support parts 15. In addition, the arm springs 42 are provided in an inclined manner with respect to the busbar 20 so that the arm springs 42 in a shape of a bar having a dogleg sectional shape may be abutted against the upper edges 22*a* of the fixed contacts 22. As the results, even in case where there are some errors in assembling the housing 10, the busbar 20 and the contact members 40 together, or in working their respective components, the arm springs 42 can be reliably contacted with the fixed contacts 22, and hence, defective electrical continuity can be avoided.

Further, in the switch device S having the above described structure, the two arm springs 42 as the movable contacts are provided in a V-shape on the contact member 40, and these arm springs 42 are allowed to slide along the movable contact sliding parts 14 which are opposed interposing the sliding space 17 for the arm springs 42. Therefore, it is possible to electrically connect the fixed contact 22 disposed at one of the movable contact sliding parts 14 to the fixed contact 22 disposed at the other movable contact sliding part 14 by means of the contact member 40. In short, the two busbars 20 can be connected or disconnected with the simple structure.

It is to be noted that the invention is not limited to the above described embodiment, but various modifications, improvements, and so on can be appropriately made. Besides, materials, shapes, sizes, numbers, positions to be arranged, and so on of constituent elements in the above described embodiment are not limited, provided that the invention can be achieved.

The present application is based on Japanese Patent Application No. 2011-000692 filed on Jan. 5, 2011, the contents of which are incorporated herein by way of reference.

INDUSTRIAL APPLICABILITY

A switch device according to the present invention can achieve reduction of cost by reducing the number of components and the number of assembling steps, and can enhance contact reliability between a fixed contact and a movable contact.

REFERENCE SIGNS LIST

1 Main Body
10 Housing
14 Movable contact sliding part
14*a* Root part
14*b* Peak part
15*c* Rib
15*e* Groove part
20 Busbar
22 Fixed contact
23 Groove part
30 Switch knob
40 Contact member
42 Arm spring (movable contact)
S Switch device

The invention claimed is:

1. A switch device comprising:

a main body provided with a busbar formed of electrically conductive material;

a switch knob which is provided in the main body so as to perform switching operation;

a movable contact sliding part which is provided in the busbar;

a movable contact, having elasticity, and configured to slide according to the switching operation of the switch knob while elastically contacting the movable contact sliding part;

a plurality of root parts, formed in the movable contact sliding part, configured to be engaged with the movable contact; and a fixed contact, formed of an end edge of the movable contact sliding part, and provided in one of the root parts, wherein an engaging position between the movable contact and the movable contact sliding part is shifted from the one of the root parts to another one of the root parts so as to switch connecting relation between the movable contact and the fixed contact, wherein a groove part is formed in the busbar between the one of the root parts and another one of the root parts which is adjacent to the one of the root parts, and wherein a rib is provided between the one of the root parts and the another one of the root parts which is adjacent to the one of the root parts, wherein the rib is configured to abut against the movable contact to deform the movable contact in an opposite direction to a direction where the movable contact is engaged with the root parts, in a state where the movable contact is positioned at the groove part.

2. The switch device as set forth in claim 1, wherein the movable contact has a cantilever shape extended from the switch knob, and the rib projects from the groove part toward an opposite side of the switch knob.

3. The switch devices as set forth in claim 1, wherein the rib projects toward an opposite direction to a direction where the movable contact is engaged with the root parts.

* * * * *